US005097513A

United States Patent [19]

Jordan et al.

[11] Patent Number: 5,097,513

[45] Date of Patent: Mar. 17, 1992

[54] SPEAKER SYSTEM ENCLOSURE INTEGRATED WITH AMPLIFIER CIRCUIT BOARD

[75] Inventors: Jon C. Jordan; Jeff B. Jordan, both of Baton Rouge, La.

[73] Assignee: Southern Audio Services, Inc., Baton Rouge, La.

[21] Appl. No.: 531,447

[22] Filed: May 31, 1990

[51] Int. Cl.[5] ..... H04R 25/00

[52] U.S. Cl. ..... 381/160; 381/111; 381/116; 381/117; 381/159

[58] Field of Search ..... 381/111, 116, 117, 160, 381/159, 156, 153, 188, 205, 96; 181/156, 153, 159, 141, 196, 198, 144

[56] References Cited

U.S. PATENT DOCUMENTS

| | | | |
|---|---|---|---|
| 3,766,334 | 10/1973 | Burke | 381/117 |
| 4,439,643 | 3/1984 | Schweizer | 381/159 |
| 4,511,768 | 4/1985 | Patel | 381/159 |
| 4,893,343 | 1/1990 | Bada | 381/159 |

*Primary Examiner*—Michael Razavi

[57] ABSTRACT

An integrated amplifier and speaker system includes a speaker having an enclosure having a closed end and an open end; an electro-acoustic driver sealingly mounted in the open end; a reflex duct connected acoustically to the enclosure through a port and having a reflex duct open end proximate to the electro-acoustic driver means; and an amplifier assembly that has an inner surface defining an interior surface of the enclosure. The amplifier subassembly further includes a circuit board that extends within the enclosure. The amplifier is electrically connected to drive the electro-acoustic driver means.

17 Claims, 2 Drawing Sheets

SPEAKER SYSTEM ENCLOSURE INTEGRATED WITH AMPLIFIER CIRCUIT BOARD

BACKGROUND OF THE INVENTION

1. Field of the Invention

The present invention is an improvement to known forms of speakers, and particularly bass-reflex subwoofers designed for corner loading. The invention integrate a mono amplifier as part of the acoustic structure of the speaker, in order to permit direction amplification of input signals, improved cooling of the amplifier circuit board, and attenuation of standing waves within the enclosure by virtue of the structure of the amplifier board and its placement.

2. Brief Description of the Prior Art

The preferred embodiment represents integration of a mono amplifier with a bass-reflex speaker adapted for corner-loading, as disclosed in PROPHIT (U.S. Pat. No. 4,567,959), which is incorporated herein by reference with respect to the preferred speaker structure.

A bass-reflex subwoofer within a tubular construction, wherein there is corner loading from a tuned chamber and a bass emitting port, has very high efficiency in terms of conversion of electrical power into acoustic power, in the low-bass region. Extreme pressures are created within the tubular main chamber. Even though the efficiency of such speakers permit operation with as little as 6 watts per channel, there commonly is need for amplification of low frequency signals. The present invention integrates an amplifier assembly which as a physical part of the acoustic chamber, for unexpected advantages over separate components.

It is known the prior art, including PHOPHIT and tubular speakers such as the SAS-T62, available from Southern Audio Services, Inc., Baton Rouge, La., that a bass efficiency of 98 dB at 1 watt in typical installations can be achieved. Such prior art speakers, however, have inherent standing waves, at different frequencies. In order to break up standing waves, fiberglass insulation pack or other interior modifications have been used. For example, OGEE, ET AL. (U.S. Pat. No. 4,126,204) illustrates a ducted bass-reflex speaker system, and discusses advantages from using different forms of sound absorbing material. As also discussed by OGEE, ET AL., the frequencies of standing waves in hollow rectangular ducts are related to the dimensions of the ducts, and it is possible to remove certain standing wave frequencies out of the reproducing frequency range by shortening the length, or height of the duct. OGEE also discloses that it is known to use a colinear pipe within a duct, in order to break up the longitudinal fluctuation of standing waves.

It is also known from FREADMAN (U.S. Pat. No. 4,625,328), that an integrated amplifier and speaker system can be constructed, wherein cooling fins are located directly behind a speaker diaphragm, in order to facilitate heat dissipation from those fins. The present invention likewise integrates an amplifier with a speaker system, but transfers heat both by convection from the front surface of a circuit board by exposure to acoustic waves, and by conduction towards external fins, on the rear surface of an aluminum base plate.

Unlike the prior art discussed above, the present invention solves standing wave problems by placing a circuit board within a speaker enclosure, and also thereby solves circuit element heat generation problems by a combination of acoustic energy convection, and conduction to the fins outside of the enclosure.

SUMMARY OF THE INVENTION

This invention preferably is applied to subwoofers, but any speaker enclosure may benefit. Preferred speakers are shown by PROPHIT, and also are available commercially as the BAZOOKA® Model SAS-T62 sold by Southern Audio Services, Inc. of Baton Rouge, La. The present invention essentially involves integrating an amplifier circuit board as an enclosure wall of a speaker enclosure. The preferred embodiment is a tubular, ducted bass-reflex unit with a 6½ inch electro-acoustic driver, and an open reflex port proximate to the electro-acoustic driver. The preferred amplifier assembly is a 40 watt mono amplifier (driving into 4 ohms), which is 2 ohm stable. This amplifier assembly preferably also includes a variable electronic crossover, to provide for both high level inputs and low level inputs. These inputs also may be summed mono internally, in order to create a high level output to be used by another subwoofer.

The invention essentially involves defining a part of the speaker enclosure by an amplifier assembly that basically comprises three parts. The first part is an aluminum plate assembly. The second part is a circuit board that is mounted on an interior surface of the aluminum plate. The third part is a gasket member, which permits a tight mounting against an aperture within the speaker enclosure.

Preferably, the enclosure is elongated between an open end supporting an electro-acoustic driver and a closed end defined by the amplifier assembly, so that the circuit board is in a plane perpendicular to the longitudinal axis of the enclosure. The circuit board also preferably is proximate a port, 38, that provides a coupling for acoustic or sound energy between the enclosure and a reflex duct extending outside of the enclosure. Back pressure waves (from the diaphragm of the driver) traveling longitudinally within the enclosure, then may splash against the full surface of the circuit board, before those waves are accelerated and turned to enter a reflex duct through a nearby port. In this fashion, significant advantages are realized.

First, acoustic waves traveling longitudinally will wash over the mono amplifier circuit board, including all heat dissipating elements, just as those waves must be accelerated in order to exit through the tuned port. Second, because the circuit board is exposed and includes various projecting circuit elements, transformers and the like, the acoustic waves meet a complex surface, which breaks up standing wave reflections. Accordingly, interior insulation, or other sound absorbing material, may not be required to break up those standing waves which degrade performance in certain frequency ranges. Hence, sonic energy will be dissipated by the surface topography of the circuit board, while also cooling the projecting set of circuit elements.

Therefore, it is the first object of the present invention combine a speaker enclosure and a mono amplifier, wherein characteristics of each element interrelate so as to provide improved performance.

It is a second and related object of the prevent invention to define an integrated amplifier construction that will have improved reliability and heat transfer characteristics, because the circuit board is located so as to extend within the speaker enclosure, and be in the path of acoustic wave energy.

It is a third and related object of the present invention to improve the performance of bass-reflex subwoofers, by attenuating longitudinal standing waves without need for insulation or other additional elements within the speaker enclosure.

These, and further objects and advantages of the present invention will become apparent from the detailed description of a preferred embodiment which follows.

DETAILED DESCRIPTION OF THE PREFERRED EMBODIMENT

In a preferred embodiment of the invention, an elongated tubular enclosure, 16, has a closed end in the plane, 20, and an open end in the plane, 22. Within the open end there is mounted an electro-acoustic driver, 24. In the same plane of the open end is the open end, 36, of a base reflex duct, 32, which communicates with the interior of the tubular chamber, 16, through a port, 38. Further details and features of this particular speaker enclosure are incorporated by reference to PROPHIT (U.S. Pat. No. 4,567,959).

Figure 1:
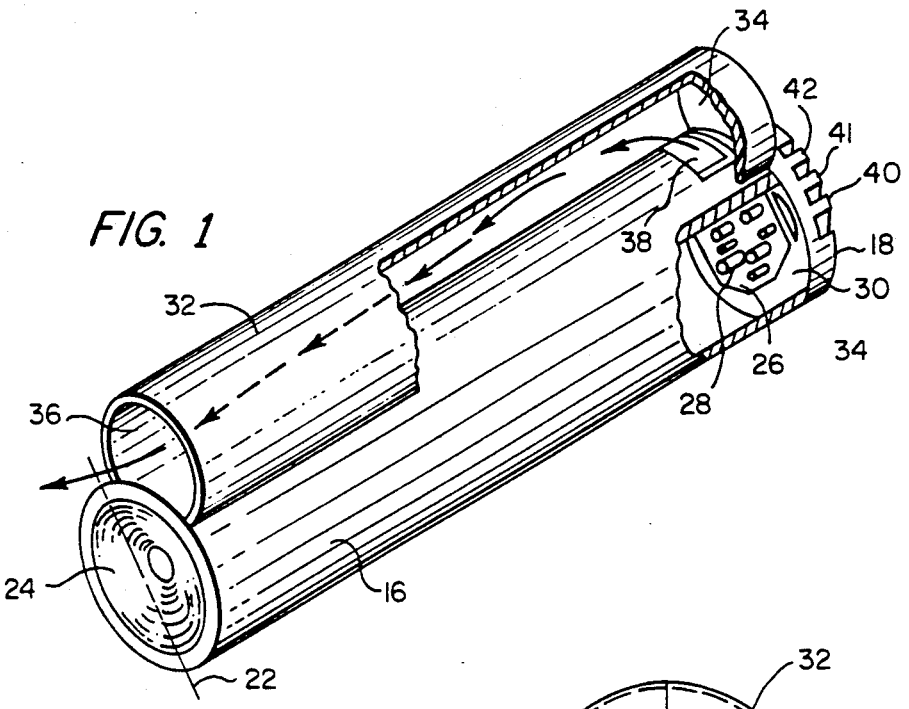
FIG. 1 is a perspective side elevation view, in partial section of a preferred bass-reflex embodiment of the present invention.
Figure 2:
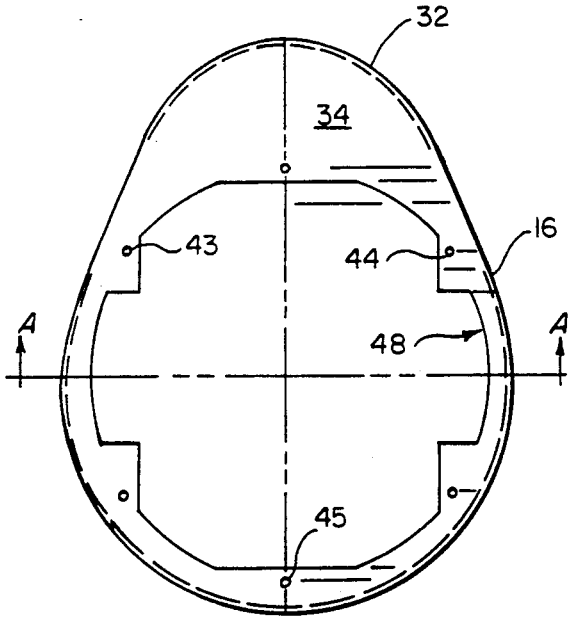
FIG. 2 is an end elevation view of the mounting plate in FIG. 1, with the mono amplifier assembly removed for clarity.

The enclosed end of both the reflex duct, 32, and part of the tubular chamber, 16, is defined by a wall, 34, which is shown in FIG. 1 and FIG. 2. The tube end wall, 34, is cutout to define a mounting surface for an aluminum plate, 18, which has several fins, 40, 41, 42, disposed on its rear surface. The front surface of the aluminum plate, 18, preferably has a gasket, 30, which surrounds a circuit board assembly, 26. The aluminum plate, 18, also includes an aperture, 46, to permit electrical connections between the circuit board, 26, and electrical signals external to the speaker enclosure. The aluminum plate may be mounted to the speaker end wall, 34, by cap screws, and representative cap screws are shown at 43, 44 and 45. End wall 34 also has a clearance aperture, 48, that is irregular in shape, in order to accept an inward projection of the circuit board and the associated circuit elements mounted thereon.

Figure 3:
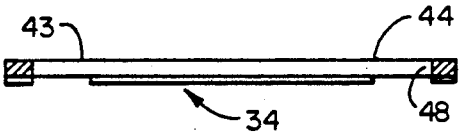
FIG. 3 is a mounting plate sectional view taken along line A—A, of FIG. 2.

As shown in FIG. 3, the end wall is a heavy material, preferably of thick ABS plastic, and the circular member, 16, also preferably is a thick wall tube of ABS plastic, for good rigidity. End wall 34 defines the closed end of the reflex duct, 32, at a location proximate to the communication between the reflex duct and the tubular main enclosure, through port, 38.

Figure 5:
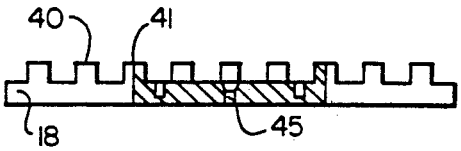
FIG. 5 is a heat sink sectional view taken along line B—B, of FIG. 4.
Figure 4:
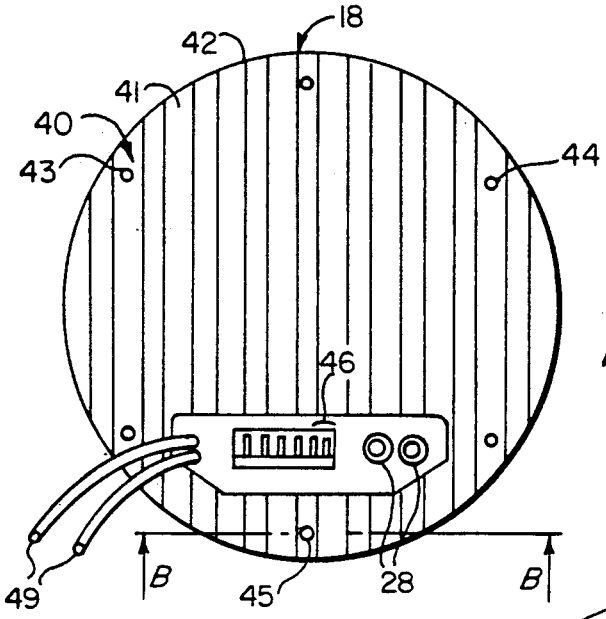
FIG. 4 is an end elevation view of the amplifier assembly heat sink OF FIG. 1, shown removed from the speaker enclosure.

As shown in FIGS. 4, 5, the aluminum end plate, 18, may have an aperture, 46, to accommodate a Molex® plug with several pins. The pins can communicate low level inputs, high level inputs, from right and left, a remote turn-on and both positive and negative high level outputs. In addition, a two pin Molex® plug may be made available for 12 volt positive amplifier power and a ground, as shown schematically by the lines, 49. If the amplifier circuit board includes a cross-over circuit, frequency response may be adjusted by potentiometers, 28. A preferred cross-over has a highest setting of between 220–250 hZ, and a cross-over lowest setting between 20–50 hZ, for example. It should be noted that the particular cross-over circuit and the particular components used to define a mono amplifier are well-known and not per se part of the present invention. The present invention requires simply that a circuit board have a number of integrated circuits, a power supply and related conventional electronic elements that extend from an inner surface of a circuit board, so as to be within the path of sonic energy inside of an enclosure.

Figure 6:
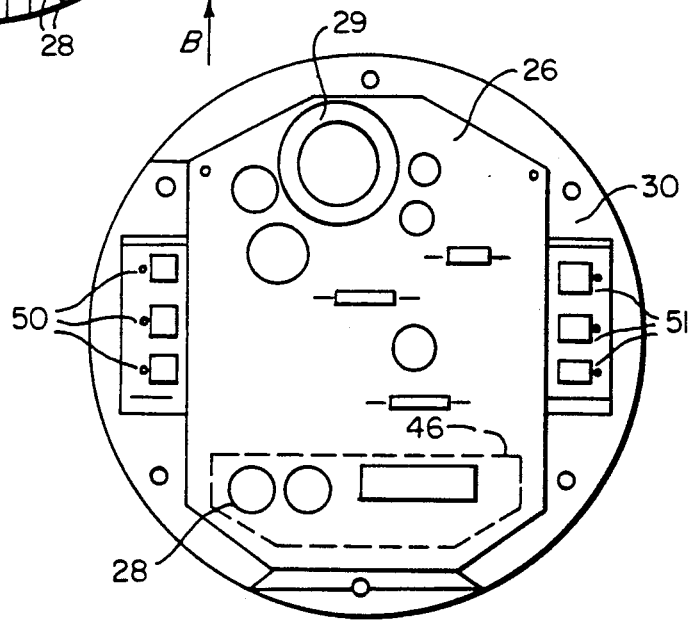
FIG. 6 is a plan view of the inner surface of the mono amplifier assembly shown in FIG. 1.

Accordingly, the circuit board illustrated in FIG. 6, is merely shown in a schematic fashion. The potentiometers 28, also shown in FIG. 5, and location of the access aperture, 46, in the aluminum plate (in dotted line) are merely illustrative. Amplifier circuit elements, such as a coil, 29, and other heat dissipating elements are shown in FIGS. 1 and 6 as extending normally to the plane of circuit board, 26. In addition, exemplary integrated circuits, 50, 51, may interconnect with the circuit board elements. All of the circuit elements are mounted on the inwardly facing surface of the circuit board, 26, and the circuit board outer surface is mounted substantially flush against an inner surface of the aluminum plate, 18. Printed circuits also may be on both sides of the circuit board. The IC elements projecting inwardly from the board perform a standing wave break-up function, as has been described herein.

Figure 7:
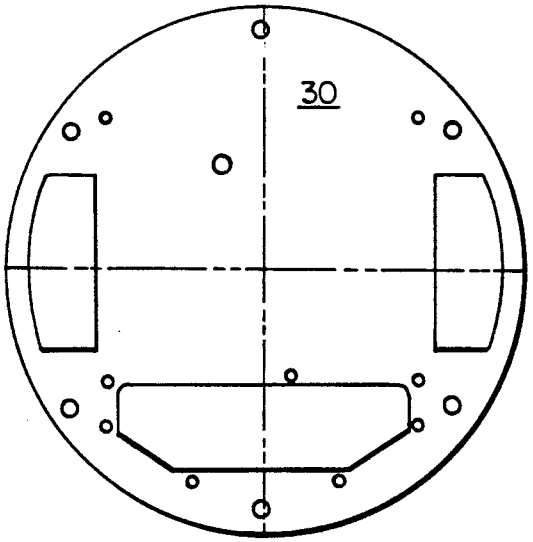
FIG. 7 is a plane view of a gasket material, shown in FIGS. 1 and 6.

FIG. 7 illustrates, in plan view, a preferred configuration of the flat gasket, 30, which is mounted between the outer surface of the circuit board, 26 and the inner surface of the aluminum heat sink, 18, to serve as an electrical insulator. The present invention requires a sealed enclosure, and the gasket, or equivalent sealing means, also insures that there will be no sound energy or pressure leakage at the annular intersection of the rear end of the tubular speaker wall and the interior surface of the aluminum heat sink.

Furthermore, while not shown, there are various wires traversing inwardly from the circuit board, 26, including at least two wires which extend from the amplifier inwardly and downwardly towards the driver, 24, at the open end, 22, of the enclosure. Various jumpers and other elements also may be mounted facing inwardly from the circuit board, 26, to act as pressure wave dissipating elements, so that unwanted standing wave reverberations will not occur.

While optional fiberglass insulation to some degree may be placed within the enclosure, 16, to dissipate standing waves, this invention significantly relies upon the surface topography of the circuit board to dissipate standing waves.

This energy dissipation also significantly occurs over a wide area, and the single circuit board, 26, covers substantially all of the plan area of the interior of the aluminum heat sink, as shown in FIG. 6.

As shown in FIG. 1, the circuit elements on the circuit board also are proximate to the port, 38. In this fashion, longitudinally propagating acoustic energy will be accelerated off of the integrated circuit elements themselves, when being directed towards the port, 38. In this fashion, cooling of heat generating elements of the circuit board is enhanced by forced convection. Since the outer surface of the circuit board directly is mounted to the inner surface of the aluminum heat sink, there also is significant heat transfer by conduction to the fins, 40, 41, 42, which are exposed to ambient outside of the enclosure. In this fashion, any heat transfer transients that develop within the interior of the speaker enclosure, by virtue of the cyclical nature of acoustic energy, can be dissipated externally through the fin structure. Therefore, there is a dual path of heat exchange, with both paths working to assist cooling of the heat generating amplifier elements.

While we have described a preferred embodiment of our invention, it is to be understood that the invention is not restricted to an amplifier mounted at any particular geometrical location on a speaker enclosure. Rather, the amplifier circuit board may be mounted in any advantageous location, wherein the IC elements extend directly into the sonic path of acoustic energy within a speaker. The invention is to be limited solely by the scope of the appended claims.

We claim:

1. An integrated amplifier and reflex duct speaker system comprising:

a speaker comprising an enclosure having a closed end wall and an open end with sidewalls that extend longitudinally therebetween;

an electro-acoustic driver means sealingly mounted in said open end;

a reflex duct connected acoustically to said enclosure through a port and having a reflex duct open and proximate to the electro-acoustic driver means; and an amplifier assembly comprising an inner surface that defines an interior wall portion surface of said enclosure and an outer surface, said amplifier subassembly further comprising a circuit board that extends inwardly from said amplifier assembly inner surface to within said enclosure, wherein said circuit board is exposed to standing waves generated within said enclosure when said amplifier is electrically connected to drive said electro-acoustic driver means.

2. The system defined in claim 1, wherein said speaker comprises an enclosure that is tubular, and said amplifier subassembly defines an interior wall portion surface that is the closed end wall of the enclosure, wherein further said amplifier assembly comprises a heat conducting plate with heat dissipating fins on its outer surface that extend outwardly from the enclosure.

3. The system defined by claim 1, wherein said enclosure comprises a hollow tube that is elongated in the longitudinal direction wherein further, said reflex duct extends in the longitudinal direction and has a closed end wall that is adjacent to the closed end wall of the enclosure.

4. The system defined by claim 3, wherein said reflex duct extends longitudinally along an exterior surface of a said elongated hollow tube.

5. The system defined by claim 3, wherein said elongated hollow tube has a circular cross-section.

6. The system defined by claim 3, wherein said elongated hollow tube has an oval cross-section.

7. The system defined by claim 1, wherein said enclosure has a rectangular cross-section.

8. The system defined by claim 1, wherein said enclosure has a longitudinal axis and comprises elongated sidewalls between the closed end wall and the open end, and the reflex duct extends in the longitudinal direction with a closed end wall that is proximate to the closed end wall of the enclosure; and said amplifier subassembly outer surface further comprises a heat conducting mounting plate that is substantially normal to the longitudinal axis of the enclosure, wherein the circuit board is mounted on an inner surface of the mounting plate and supports integrated circuit elements that extend inwardly to within the enclosure.

9. The system according to claim 8, wherein said circuit board further comprises an interior facing surface which supports the circuit elements, and an exterior surface that is directly supported by an inner surface of said mounting plate, wherein said circuit board is substantially perpendicular to the longitudinal axis of the enclosure.

10. The system defined by claim 2, wherein said circuit board further comprises an interior facing surface which supports circuit elements that extend to within said enclosure and an outer surface that is mounted directly to an inner surface of an aluminum mounting plate that also defines the outer surface of said closed end wall, wherein both said plate and said circuit board are substantially perpendicular to the longitudinal axis of said enclosure.

11. The system defined by claim 1, wherein said amplifier subassembly further comprises a mounting plate with an inner surface and an outer surface, and the circuit board has an inner surface with heat dissipating elements mounted thereon and has an outer surface that is mounted directly upon the inner surface of the mounting plate so that an inner surface of said circuit board, and the mounted heat dissipating elements, define an interior wall surface portion of the enclosure.

12. The system according to claim 11, wherein said mouting plate comprises an aluminum member having heat dissipating elements on its outer surface, and a substantially planar inner surface that mounts in heat conducting fashion against the outer surface of said circuit board.

13. An integrated amplifier and speaker system comprising:

a speaker defined by an enclosure having an open first end and a closed second end wall with side walls exending therebetween, wherein an electro-acoustic driver is mounted within said open frist end;

an amplifier assembly mounted so as to define a wall surface portion of said enclosure, said amplifier assembly comprising a circuit board means for amplifying an external signal and creating an output that is connected to said electro-acoustic driver, said circuit board comprising heat-dissipating circuit elements that extend upwardly from an inner surface of said circuit board and to within said enclosure so as to be in the path of air driven within the walls of said enclosure by the electro-acoustic driver; and a heat sink with an inner surface that supports said circuit board means and an exterior surface comprising a heat dissipating surface, whereby heat generated by said circuit board means is cooled via convection by air driven within the walls of said enclosure and also is transferred outside of said enclosure via conduction through said heat sink.

14. The system defined by claim 13, wherein said amplifier assembly is mounted so as to define the closed second end wall of said speaker enclosure.

15. The system defined by claim 13, wherein the enclosure is elongated in the longitudinal direction between said open first end and said closed second end wall, and is substantially tubular in cross-sectional area, wherein said amplifier assembly is substantially circular in cross-section and is mounted so as to define the closed second end wall of said enclosure.

16. The system according to claim 13, wherein said speaker comprises a base reflex-ducted port design, wherein a reflex duct communicates with the interior of said enclosure through a port and said reflex duct has an open end that is proximate to the electro-acoustic driver mounted within the first open end of said enclosure.

17. The system according to claim 16, wherein said reflex duct extends longitudinally, has a closed end that is proximate to said prot and is mounted on an exterior surface of said enclosure.

* * * * *